US007024966B2

(12) United States Patent
Chao

(10) Patent No.: US 7,024,966 B2
(45) Date of Patent: Apr. 11, 2006

(54) POSITIONABLE POWER SCREWDRIVER

(75) Inventor: Shenq Ruey Chao, Taichung (TW)

(73) Assignee: Mobiletron Electronics Co., Ltd., Taichung Hsien (TW)

( * ) Notice: Subject to any disclaimer, the term of this patent is extended or adjusted under 35 U.S.C. 154(b) by 82 days.

(21) Appl. No.: 09/908,647

(22) Filed: Jul. 20, 2001

(65) Prior Publication Data

US 2003/0015066 A1 Jan. 23, 2003

(51) Int. Cl.
*B25B 17/00* (2006.01)

(52) U.S. Cl. ..... 81/57.26; 81/177.7; 81/177.8; 16/438

(58) Field of Classification Search ..... 81/177.7, 81/177.8, 177.9, 57.26; 16/438, 111.1
See application file for complete search history.

(56) References Cited

U.S. PATENT DOCUMENTS 4,759,240 A 7/1988 Lin
6,102,134 A 8/2000 Alsruhe
6,386,075 B1 * 5/2002 Shiao ..... 81/177.7
6,405,620 B1 * 6/2002 Liao ..... 81/177.7
6,405,621 B1 * 6/2002 Krivec et al. ..... 81/177.9

FOREIGN PATENT DOCUMENTS

EP 0027238 A2 4/1981

* cited by examiner

*Primary Examiner*—Joseph J. Hail, III
*Assistant Examiner*—Alvin J. Grant
(74) *Attorney, Agent, or Firm*—Bacon & Thomas, PLLC

(57) ABSTRACT

A positionable screwdriver includes a first housing member, a second housing member pivotally connected with the first housing member, and a positionable mechanism arranged between the first and second housing members. The positionable mechanism has a locking button, a leaf spring, a positioning block, a retaining member, and a spring. The positioning block is formed with a plurality of radial teeth and fixed to the first and second housing members. The locking button is arranged within the second housing member and positioned over the leaf spring. A top of the locking button is provided with a raised portion extending upwardly through an opening of the second housing member. The spring has an end bearing against another end of the locking button so as to keep the locking button positioned over the leaf spring, thereby keeping engagement between the leaf button and the positioning block.

3 Claims, 4 Drawing Sheets

POSITIONABLE POWER SCREWDRIVER

BACKGROUND OF THE INVENTION (a) Field of the Invention

The present invention relates to a positionable power screwdriver and in particular to one having a mechanism which can actively retain the housing portions in a plurality of positions with respect to one another thereby enabling it to be operated in various positions.

(b) Description of the Prior Art

The screwdriver is a tool for driving screws that consists of a handle or power tool with a metal rod shaped at the tip to fit into the head of a screw. However, it is difficult to use a screwdriver in some spaces due to restricted space. Even when able to position the screwdriver, maneuverability is difficult and it is hard to apply sufficient force to turn the screwdriver.

Therefore, it is an object of the present invention to provide a positionable screwdriver which can obviate and mitigate the above-mentioned drawbacks.

SUMMARY OF THE INVENTION

This invention is related to a positionable screwdriver.

It is the primary object of the present invention to provide a positionable screwdriver which can actively retain the housing portions in a plurality of positions with respect to one another thereby enabling it to be operated in various positions.

According to a preferred embodiment of the present invention, a positionable screwdriver includes a front housing member, a second housing member pivotally connected with the first housing member, and a positionable mechanism arranged between the first and second housing members, the positionable mechanism having a locking button, a leaf spring, a positioning block, a retaining member, and a spring, the positioning block being formed with a plurality of radial teeth and pivotally connected with the first and second housing members, the locking button being arranged within the second housing member and having an end fitted between two radial teeth of the positioning block, a top of the locking button being provided with a raised portion extending upwardly through an opening of the second housing member, an end of the spring bearing against another end of the locking button so as to push the locking button toward the positioning block thereby keeping engagement between the locking button and the positioning block.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DESCRIPTION OF THE PREFERRED EMBODIMENT

Figure 1:
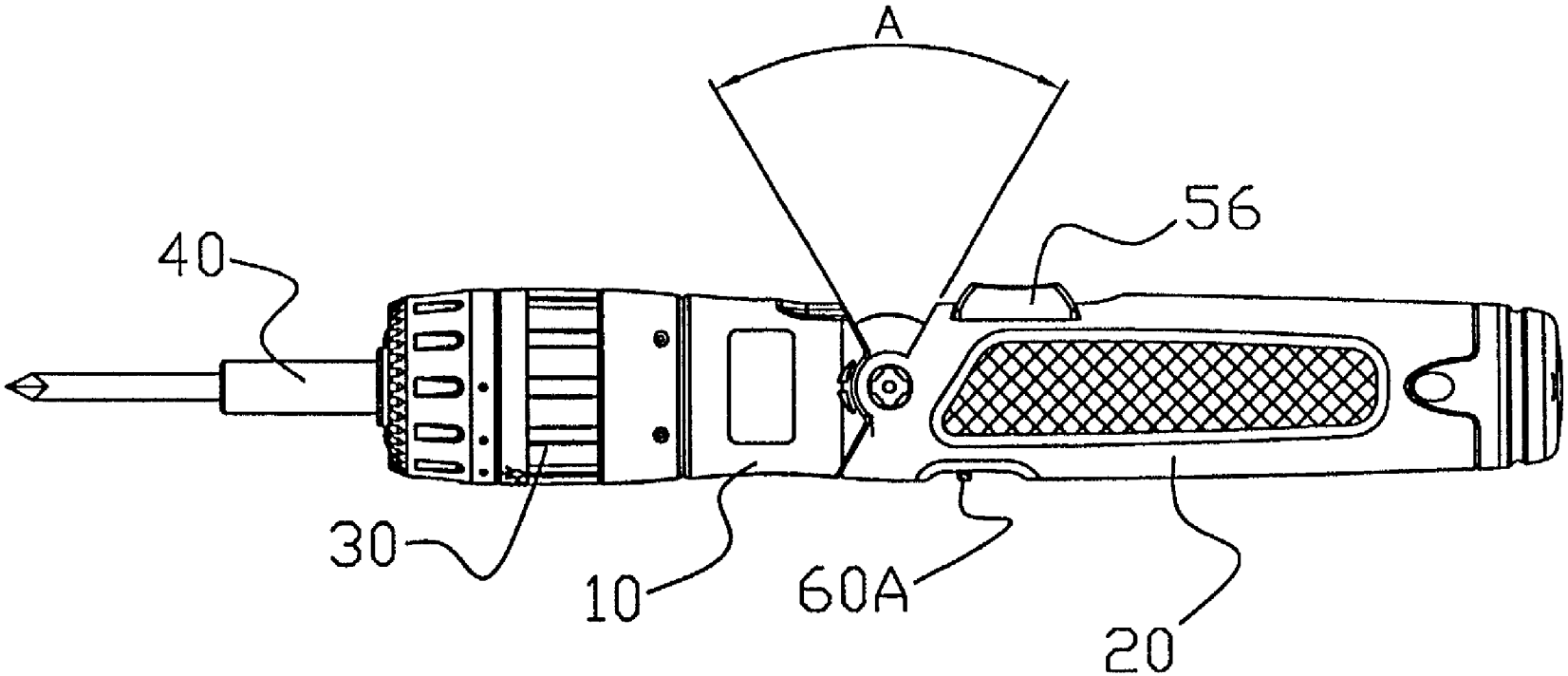
FIG. 1 is a side view of a positionable power screwdriver according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, alterations and further modifications in the illustrated device, and further applications of the principles of the invention as illustrated herein being contemplated as would normally occur to one skilled in the art to which the invention relates.

Referring to FIG. 1, the positionable power screwdriver according to the present invention generally comprises a front housing member 10 and a second housing member 20 which is pivotally connected with the first housing member 10. A cut-out portion A is formed between the first and second housing members 10 and 20 so that the second housing member 20 can be rotated into the first housing member 10. A gear box 30 is engaged with the other end of the first housing member 10. An output spindle 40 which is drivingly connected with the gear box 30 has an end extending out of the of the gear box 30. Within the first and second housing members 10 and 20 is mounted a power driving mechanism which comprises a battery pack 50, a negative electrode member 51, a positive electrode member 52, a conductor seat 53, a temperature sensor 54, a control circuit board 55, a power switch 56 and an electric motor 57 (see FIG. 2). The function of the component parts of the driving mechanism will not be described here in detail as they are features of the present invention. A positionable mechanism is arranged between the first and second housing members 10 and 20.

Figure 2:
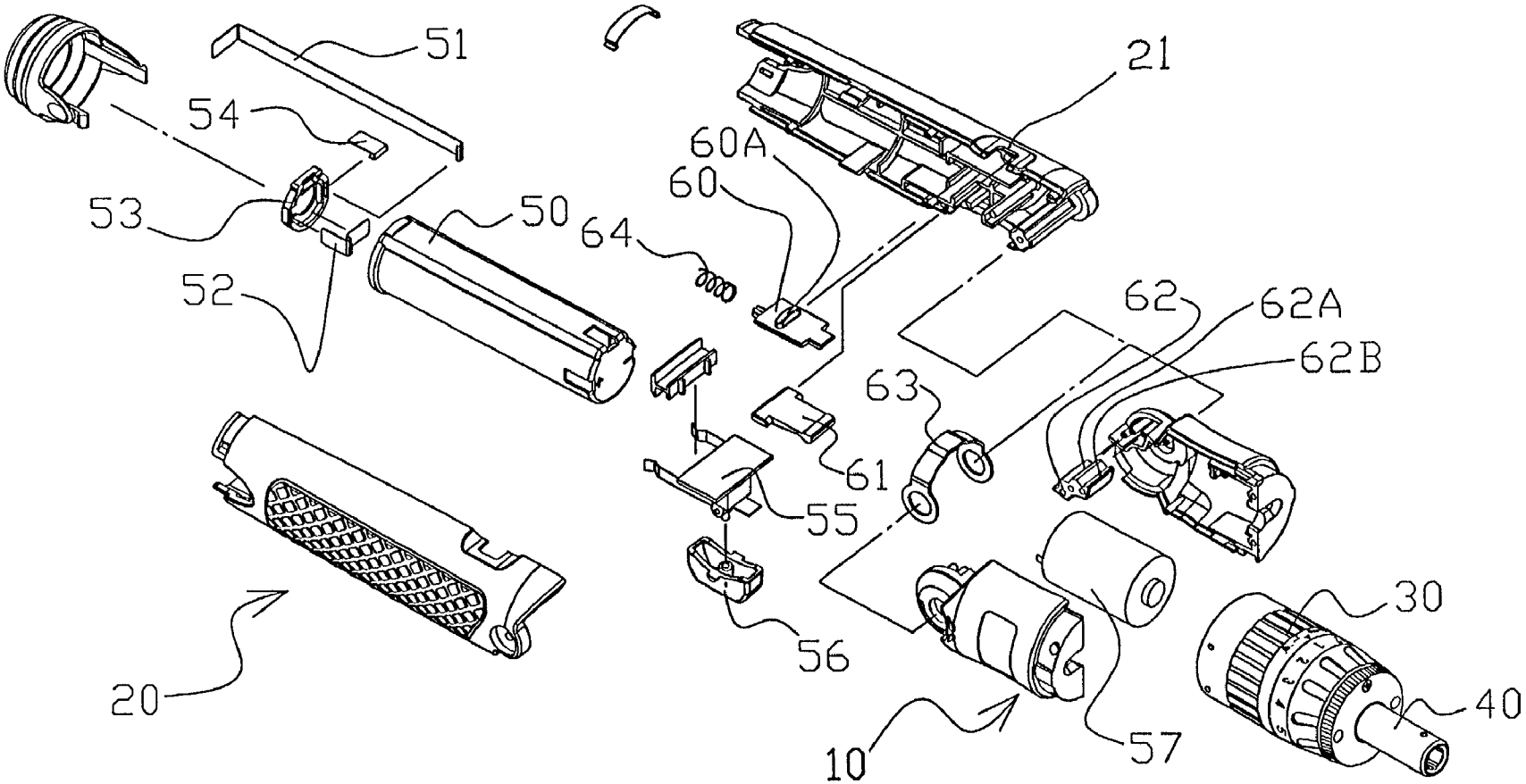
FIG. 2 is an exploded view of the present invention.
Figure 3:
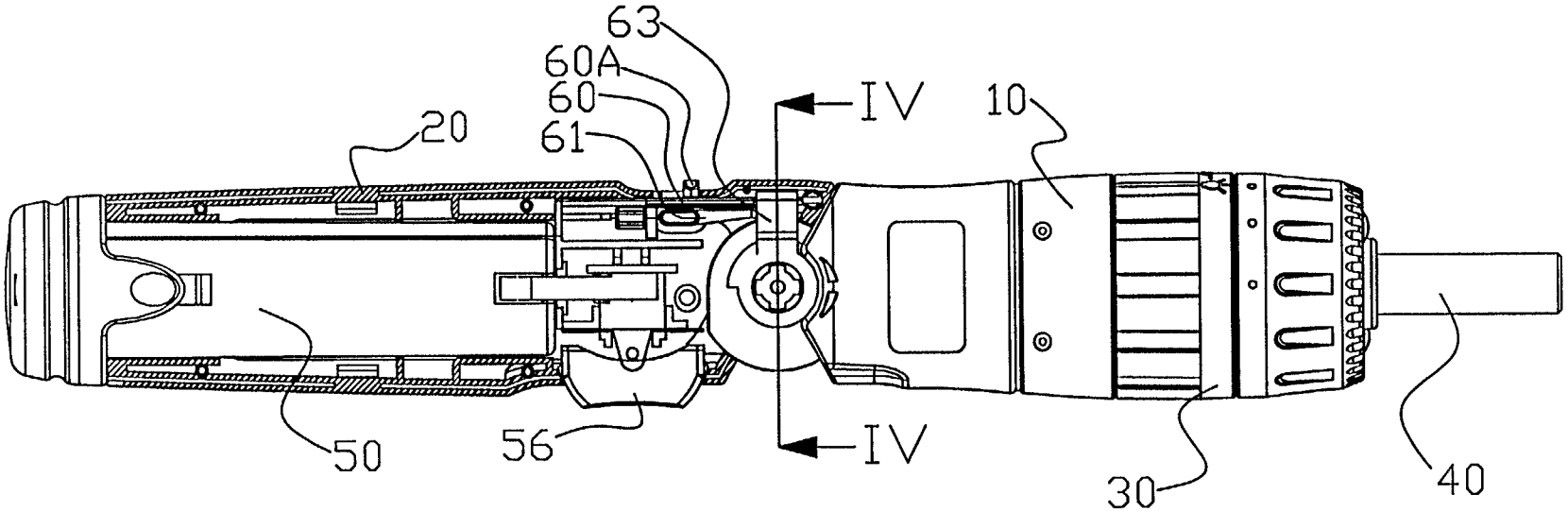
FIG. 3 is a sectional view of the present invention.
Figure 4:
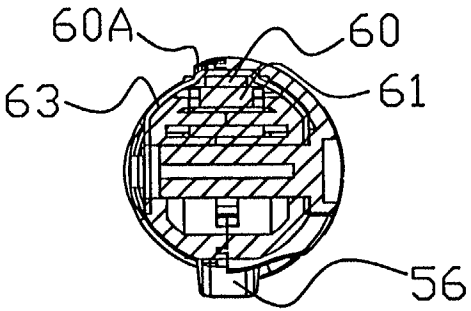
FIG. 4 is a sectional view taken along line IV—IV of FIG. 3.

As shown in FIGS. 2,3 and 4, the positionable mechanism comprises a locking button 60, a leaf spring 61, a positioning block 62, a retaining member 63, and a resilient means 64 such as a spring made of metal or plastic. The positioning block 62 is formed with a plurality of radial teeth 62A, 62B, . . . and pivotally connected with the first and second housing members 10 and 20. The locking button 60 is arranged within the second housing member 20 and has an end fitted between two radial teeth of said positioning block 62. The top of the locking button 60 is provided with a raised portion 60A extending upwardly through an opening 21 of the second housing member 20, so that the user may hold the raised portion 60A to move the locking button 60 to a desired position. An end of the spring 64 bears against the other end of the locking button 60 so as to push the locking button toward the positioning block 62 thereby keeping the engagement between the locking button 60 and the positioning block 62. The retaining member 63 has two lugs between which is fitted the positioning block 60. The leaf spring 61 is fitted within the second housing member 20 and arranged right under the locking button 60.

Figure 5:
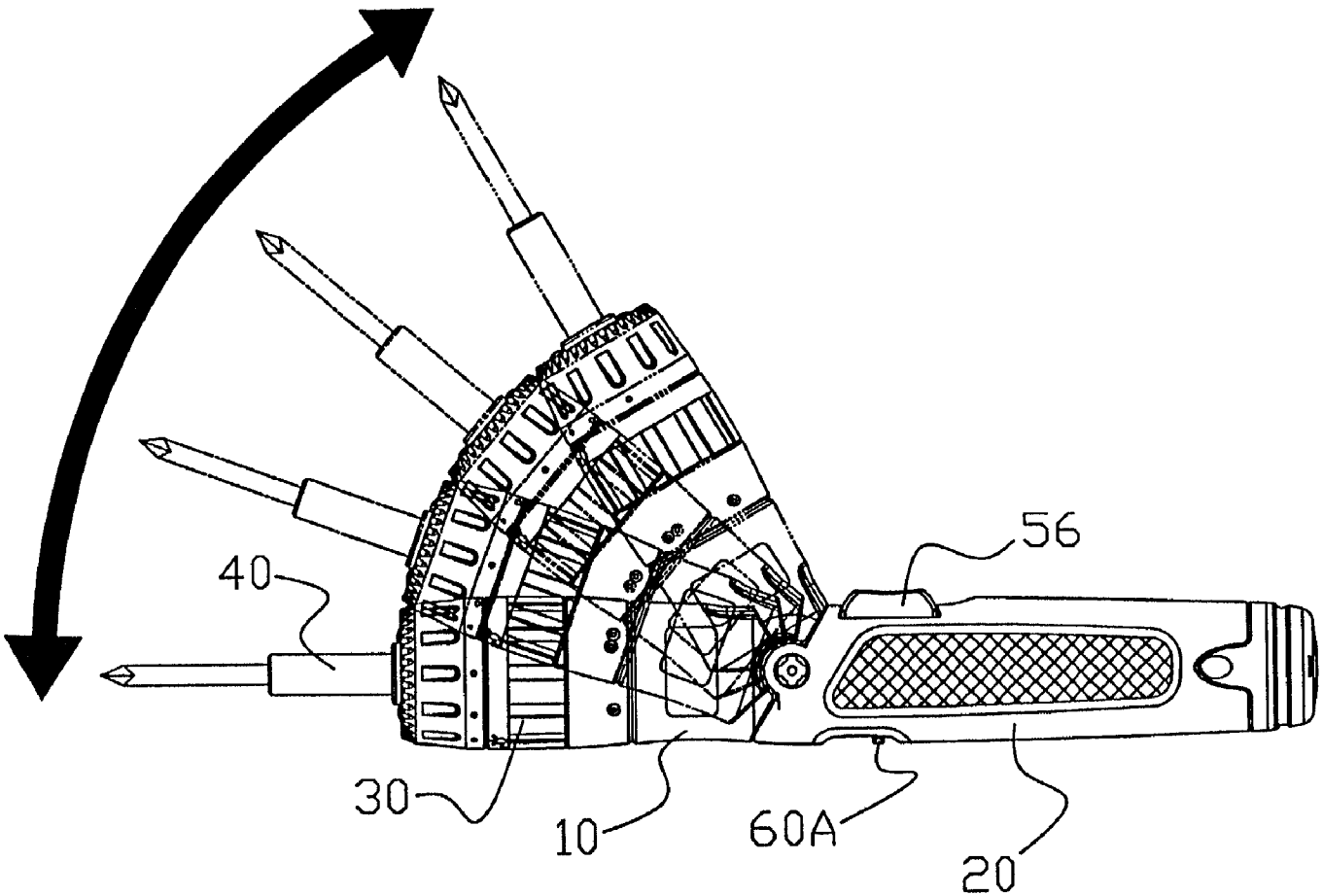
FIG. 5 is a working view of the present invention.

When the locking button 60 is arranged at its normal position, the locking button 60 is located right above the leaf spring 61 and engaged with the positioning block 62, so that the first and second housing members 10 and 20 can not be rotated with each other thereby preventing the screwdriver from bending inadvertently and therefore providing security in operation. The leaf spring 61 is used for reinforcing the locking button 60 to withstand the torque produced when a force is inadvertently applied to bend the first housing member 10 with respect to the second housing member 20. When desired to bend the first housing member 10 with respect to the second housing member 20, it is only necessary to move the locking button 60 toward the free end of the second housing member 20 so that the locking button 60 is disengaged from the radial teeth of the positioning block 62 thereby enabling the first housing member 10 to be rotated with respect to the second housing member 20. As the locking button 60 is released, the spring 64 will push the locking button 60 to go forward to engage with the teeth of the positioning block 62 thus retaining the position of the first housing member 10 with respect to the second housing member 20. As shown in FIG. 5, the first housing member 10 can be retained in a plurality of positions with respect to the second housing member 20 so that the present invention can be utilized at various angles with respect to the workpiece.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A positionable screwdriver comprising:

a first housing member;

a second housing member pivotally connected with said first housing member; and a positionable mechanism arranged between said first and second housing members, said positionable mechanism comprising a locking button, a leaf spring, a positioning block, a retaining member, and a resilient means, said positioning block being formed with a plurality of radial teeth and fixed to said first housing member, said leaf spring being fitted within said second housing member and arranged right under the locking button and having an end fitted between two radial teeth of said positioning block, said locking button being arranged within said second housing member and positioned over said leaf spring, a top of said locking button being provided with a raised portion extending upwardly through an opening of said second housing member, an end of said resilient means bearing against another end of said locking button so as to keep said locking button positioned over said leaf spring, thereby keeping engagement between said locking leaf spring and said positioning block.

2. The positionable screwdriver as claimed in claim 1, wherein said resilient means is a spring.

3. The positionable screwdriver as claimed in claim 1, wherein said resilient means is made of plastic.

* * * * *